US011121492B2

(12) United States Patent
Dillmann et al.

(10) Patent No.: US 11,121,492 B2
(45) Date of Patent: Sep. 14, 2021

(54) HIGH-CURRENT CONNECTOR

(71) Applicant: Robert Bosch GmbH, Stuttgart (DE)

(72) Inventors: Adolf Dillmann, Muensingen (DE); Stefan Huehner, Kusterdingen-Jettenburg (DE); Reiner Holp, Winterlingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/753,964

(22) PCT Filed: Sep. 20, 2018

(86) PCT No.: PCT/EP2018/075426

§ 371 (c)(1),
(2) Date: Apr. 6, 2020

(87) PCT Pub. No.: WO2019/072513

PCT Pub. Date: Apr. 18, 2019

(65) Prior Publication Data

US 2020/0395701 A1 Dec. 17, 2020

(30) Foreign Application Priority Data

Oct. 13, 2017 (DE) ..... 10 2017 218 326.8

(51) Int. Cl.
*H01R 13/04* (2006.01)
*H01R 13/187* (2006.01)
(Continued)

(52) U.S. Cl.
CPC ..... *H01R 13/187* (2013.01); *H01R 13/04* (2013.01); *H01R 13/14* (2013.01); *H01R 13/44* (2013.01); *H01R 2101/00* (2013.01)

(58) Field of Classification Search
CPC .. H01R 13/2421; H01R 13/502; H01R 13/03; H01R 13/506; H01R 13/639;
(Continued)

(56) References Cited

U.S. PATENT DOCUMENTS 4,564,259 A * 1/1986 Vandame ..... H01R 13/113 439/290
4,714,441 A 12/1987 Corman
(Continued)

FOREIGN PATENT DOCUMENTS

CN 1320986 A 11/2001
CN 201274361 Y 7/2009
(Continued)

OTHER PUBLICATIONS

International Search Report for Application No. PCT/EP2018/075426 dated Dec. 10, 2018 (English Translation, 2 pages).

*Primary Examiner* — Truc T Nguyen
(74) *Attorney, Agent, or Firm* — Michael Best & Friedrich LLP

(57) ABSTRACT

The invention relates to a high-current plug connector (1) for an electrical connection between a first line (11) and a second line (12), comprising: a plug pin (2) that can be connected to the first line (11), a plug socket (3) that can be connected to the second line (12), a contact cage (4), which is arranged between the plug pin (2) and the plug socket (3) and is designed to establish electrical contact between the plug pin (2) and the plug socket, a spring element (5), which exerts a preload (F) in the axial direction (X-X) of the high-current plug connector, and a flexible connection element (6), by means of which the plug pin (2) can be connected to the first line (11) and/or by means of which the plug socket (3) can be connected to the second line (12).

19 Claims, 7 Drawing Sheets

(51) Int. Cl.
*H01R 13/14* (2006.01)
*H01R 13/44* (2006.01)
*H01R 101/00* (2006.01)

(58) Field of Classification Search
CPC ..... H01R 13/7175; H01R 2201/26; H01R 12/714; H01R 13/111; H01R 13/187; H01R 13/20; H01R 13/24; H01R 13/521; H01R 13/5219; H01R 13/703; H01R 2101/00; H01R 2103/00; H01R 2105/00; H01R 24/76; H01R 43/20; H01R 11/00; H01R 11/01; H01R 11/12; H01R 11/18; H01R 12/57; H01R 12/7082; H01R 12/716; H01R 12/718; H01R 13/04; H01R 13/08; H01R 13/2428; H01R 13/42; H01R 13/4361; H01R 13/4364; H01R 13/4534; H01R 13/4538; H01R 13/465; H01R 13/50; H01R 13/512; H01R 13/514; H01R 13/52; H01R 13/53; H01R 13/533; H01R 13/58; H01R 13/5816; H01R 13/5845; H01R 13/6205; H01R 13/6215; H01R 13/6273; H01R 13/6392; H01R 13/64; H01R 13/641; H01R 13/645; H01R 13/6456; H01R 13/6581; H01R 13/66; H01R 13/6608; H01R 13/6641; H01R 13/665; H01R 13/6683; H01R 13/6691; H01R 13/7031; H01R 13/7035; H01R 13/7039; H01R 13/707; H01R 13/71; H01R 13/713; H01R 13/717; H01R 13/719; H01R 13/73; H01R 2107/00; H01R 2201/06; H01R 24/22; H01R 24/30; H01R 24/38; H01R 24/86; H01R 33/0818; H01R 33/0854; H01R 43/005; H01R 43/02; H01R 43/0235; H01R 4/02; H01R 4/18; H01R 4/58; H01R 9/03; H01R 9/11; H01R 9/20; H01R 9/24; H01R 9/26
See application file for complete search history.

(56) References Cited

U.S. PATENT DOCUMENTS 5,329,262 A * 7/1994 Fisher, Jr. ..... H01R 13/6315 333/260
5,474,466 A * 12/1995 Sakuraoka ..... H01R 13/625 439/319
5,603,306 A * 2/1997 Tai ..... H01B 7/0063 123/633
5,921,803 A * 7/1999 Mori ..... H02J 7/0045 439/387
6,478,619 B1 * 11/2002 Wiechmann ..... H01R 13/533 439/587
6,932,625 B2 * 8/2005 Yagi ..... H01R 31/08 439/76.2
7,097,480 B2 * 8/2006 Fukuzaki ..... H01R 24/46 439/188
7,641,489 B1 * 1/2010 Hsu ..... H01R 13/4538 439/188
8,011,940 B1 * 9/2011 Wu ..... H01R 13/71 439/188
8,414,339 B1 * 4/2013 Glick ..... H01R 13/187 439/843
8,678,867 B2 * 3/2014 Glick ..... H01R 13/187 439/843
8,777,658 B2 * 7/2014 Holland ..... H01R 13/7036 439/578
8,968,021 B1 * 3/2015 Kennedy ..... H01R 13/6271 439/352
9,496,632 B2 * 11/2016 Schmalbuch ..... B23K 1/002
2002/0108413 A1 * 8/2002 Hyatt, Jr. ..... E05B 47/063 70/278.3
2006/0276061 A1 * 12/2006 Koguchi ..... H01R 12/725 439/74
2009/0061655 A1 * 3/2009 Miyazaki ..... H01R 12/57 439/74
2010/0048041 A1 * 2/2010 Lei ..... H01R 12/716 439/74
2010/0221928 A1 * 9/2010 Sato ..... H01R 12/716 439/74
2011/0045679 A1 * 2/2011 Yu ..... H01R 12/716 439/66
2011/0254450 A1 * 10/2011 Bergholz ..... H05B 45/58 315/121
2013/0323954 A1 12/2013 Eckel et al.
2015/0140840 A1 * 5/2015 Nishimura ..... H01R 13/6594 439/74
2018/0123264 A1 5/2018 Huehner et al.

FOREIGN PATENT DOCUMENTS

CN 102290663 A 12/2011
CN 103872484 A 6/2014
CN 205790493 U 12/2016
DE 9217337 4/1994
DE 10140177 4/2003
DE 102011004347 8/2012
DE 102015203518 9/2016
DE 102015203518 A1 9/2016
EP 0949721 10/1999
FR 2754645 4/1998
JP 2008276991 A 11/2008
JP 2013058366 A 3/2013
JP 2013187170 9/2013
JP 2014232688 A 12/2014
JP 2016528709 A 9/2016
WO 2008092284 8/2008

* cited by examiner

HIGH-CURRENT CONNECTOR

BACKGROUND

The present invention relates to a high-current plug connection for producing an electrical connection. The present invention furthermore relates to a vehicle and a vehicle assembly comprising a high-current plug connection for connecting an inverter to an electric machine or to an electrical energy store.

Plug connections are known in a wide variety of embodiments from the field of power electronics. Here, use is commonly made of plug contact systems with spring contacts or with screw connections. Here, a disadvantage in particular of screw connections is that, in this case, accessibility for a screwing tool is required. By contrast, plug contacts can be joined in a concealed manner. In the field of automotive engineering, the required plugging forces should in this case be less than 75 N. A disadvantage in the use of so-called spring contacts is the poor electrical and thermal conductivities owing to the required spring characteristics of the contacts. Furthermore, the contacts are commonly punctiform or linear and limited to a few $mm^2$. The very small contact surfaces however result in a high electrical and a high thermal resistance, which leads to intense warming of the contact system. This however limits a current-carrying capacity. Here, the limit temperature for contact systems has hitherto been approximately 180° C. Furthermore, DE 10 2015 203 518 A1 has disclosed a plug connection in the case of which an electrical connection by means of a collet chuck with two or more clamping jaws is proposed.

SUMMARY

The high-current plug connection according to the invention has the advantage here that only low plugging forces are required for the connection of a plug pin to a plug socket. Here, according to the invention, it is in particular not necessary for contact zones to be expanded, and a contact force acts only over a very short travel. The expenditure of force is preferably minimized by means of levers or wedges. Furthermore, a very low electrical and thermal transition resistance is present. Furthermore, a relative movement at the contact regions as a result of warming can be prevented owing to an intense surface pressure. This is achieved according to the invention in that the high-current plug connection has, aside from the plug pin and the plug socket, a contact cage which is arranged between the plug pin and the plug socket. The contact cage provides electrical contact between the plug pin and the plug socket. Furthermore, a separate spring element is provided which exerts a preload in the axial direction of the high-current plug connection between plug pin and plug socket. Here, the axial direction of the high-current plug connection is at the same time also the plugging direction. Thus, it is possible to realize a plug contact system without spring contacts or the like, because the axial preload force is imparted by means of the separate spring element outside the plug connection itself. In this way, it is furthermore possible for the surfaces of the contact components to be able to be coated. Furthermore, the high-current plug connection according to the invention can also withstand high vibrational loads without a relative movement occurring between the direct contact components. Here, the relative movement is prevented even in the μm range. Thus, the high-current plug connection according to the invention is suitable in particular for use in vehicles. The construction according to the invention of the high-current plug connection furthermore ensures a small structural height, because only a small joining depth is required. Also, multi-plug connections are possible, and easy thermal attachment of the contact regions to a heat sink for the purposes of heat dissipation is possible, which further improves utilization in vehicles.

Since the spring element is provided separately from the contact components themselves, a configuration of the spring element exclusively with regard to the desired spring characteristics can be made possible. In the prior art, the spring tongues that have hitherto been used must not only be configured with regard to the spring characteristics but must also fulfil a configuration with regard to a transmission of current, such that, in each case, it is not possible to achieve the optimum for the respective requirements. This can be resolved by means of the present invention.

The contact cage preferably has a multiplicity of contact tongues which are in direct contact substantially in a radial direction with the plug pin, at one side, and with the plug socket, at the other side. Here, it is particularly preferable for each contact tongue to have a first and second 180° bend. In this way, the contact cage can exhibit high stability.

It is preferable here for the first and second 180° bends to be bent in the same direction, so as to result in a spiral-like internal winding with three parallel regions. A cross section of the contact tongues is preferably tetragonal, in particular rectangular. In this way, on the contact tongues, large-area lines of contact with the plug pin at one side and with the plug socket at the other side can be made possible.

It is preferable if first contact regions of the contact tongue lie in a first plane and second contact regions of the contact tongues lie in a second plane, wherein the first plane is parallel to the second plane.

It is preferable if the contact tongues form a cylindrical casing element or the contact tongues form a conical casing element.

It is furthermore preferable if the high-current plug connection furthermore comprises a cap composed of an insulating material, having a cylindrical main body and having a cover region with a passage opening for the leadthrough of the plug pin. The passage opening is preferably a centering device. In this way, the plug pin can be centered in the passage opening during the joining process, such that a reliable joining process is possible without transverse forces that could act on the contact cage and/or the plug socket.

From safety aspects, the plug pin furthermore comprises, at an end side directed toward the plug socket, an insulating element, in particular an insulating pin with a head which covers the entire end side.

The separate spring element is preferably a conical spring, wave spring, disk spring or a helical spring.

In a further preferred embodiment of the invention, the high-current plug connection furthermore comprises a cover element which is composed of an insulated material and which is arranged on the plug pin. In this way, a simple touch protection means, in particular in the case of high-voltage applications, can be made possible.

A construction of the high-current plug connection is preferable such that the spring element bears against the plug socket and/or such that the spring element bears against the plug pin. It is pointed out that it is commonly sufficient to provide only one spring element, which exerts a spring force either on the plug socket or on the plug pin. Here, the spring element may be in direct contact with the plug socket or with the plug pin, or it is additionally also possible for an intermediate element, for example a housing for accommodating the spring element, to be provided if desired.

The high-current plug connection furthermore preferably comprises a cooling element. The cooling element is particularly preferably arranged at a rear side of the plug pin and/or at a rear side of the plug socket. Direct cooling of the high-current plug connection can thus be made possible. Here, the cooling element may be a cooling circuit which is present in the application, for example a cooling circuit of an electric motor of a vehicle, or a cooling body may be used.

The plug pin and/or the plug socket and/or the plug cage furthermore preferably have no coating. Furthermore, it is alternatively possible for components to be coated. The coating is preferably formed with a coating material comprising Sn, Ag, Au and/or Pa.

Furthermore, a flexible connecting element is preferably provided by means of which the plug pin is connectable to a first electrical line and/or by means of which the plug socket is connectable to a second electrical line.

The present invention furthermore relates to a busbar plug connection, comprising a high-current plug connection according to the invention. The busbar plug connection connects power electronics preferably to an electric machine, in particular to an electric motor of a vehicle.

The present invention furthermore relates to a vehicle assembly comprising a high-current plug connection according to the invention, which is configured for a plug connection between an electric motor of a vehicle and electrical power electronics. By means of the high-current plug connection according to the invention, owing to the small structural space, multi-plug connections in parallel arrangements are easily possible. The invention also relates to a vehicle having a vehicle assembly of said type.

BRIEF DESCRIPTION OF THE DRAWINGS

Preferred exemplary embodiments of the invention will be described in detail below with reference to the accompanying drawing. In the drawing.

DETAILED DESCRIPTION

A high-current plug connection 1 according to a first preferred exemplary embodiment of the invention will be described in detail below with reference to FIGS. 1 to 10.

Figure 1:
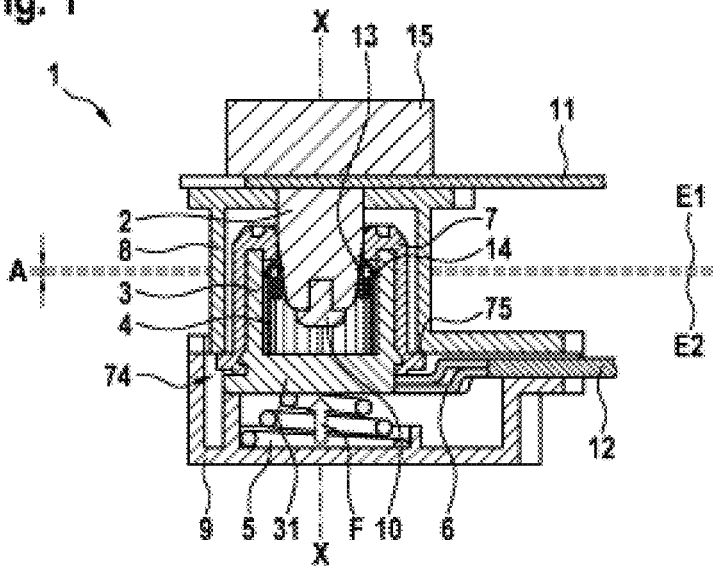
FIG. 1 shows a schematic sectional view of a high-current plug connection according to a first preferred exemplary embodiment of the invention.

As can be seen from FIG. 1, which shows the plugged-together state, the high-current plug connection 1 comprises a plug pin 2, a plug socket 3 and a contact cage 4. The contact cage 4 is arranged in a cylindrical main receiving space 30 of the plug socket 3. The contact cage 4 is thus arranged between the plug pin 2 and the plug socket 3. The contact cage 4 has a conical envelope.

Furthermore, the high-current plug connection 1 comprises a spring element 5, which in this exemplary embodiment is a conical spring. The spring element 5 is a separate element and is arranged outside the plug connection itself.

The plug pin 2 is connectable to a first line 11, for example busbar, and the plug socket 3 is connectable to a second line 12.

As can also be seen from FIG. 1, the high-current plug connection 1 furthermore comprises a flexible connection element 6 which is arranged between the plug socket 3 and the second line 12. The flexible connection element 6 prevents an action of force, which may occur for example during the plugging process, on the second line 12.

Furthermore, a cap 7 composed of an electrically insulating material is provided. The cap 7 fully surrounds the plug socket 3. The cap 7 is shown in detail in FIGS. 7 and 8 and has a cylindrical main body 72 and a passage opening 71 in a cover region. The passage opening 71 serves for the leadthrough of the plug pin 2 as illustrated in FIG. 1. Here, the passage opening 71 is designed as a centering device and centers the plug pin 2. Here, a cylindrical main body 20 of the plug pin lies in the passage opening 71. The cap 7 furthermore additionally comprises a stop 73 for the plug socket 3, and a clip connection 74 for a process of joining to the plug socket 3.

Furthermore, the high-current plug connection comprises, as a touch protection means, a cover element 8 which is arranged on the plug pin 2, wherein the plug pin 2 is led through the cover element 8, and the cover element 8 protects the high-current plug connection 1 against external influences. As shown in FIG. 1, a lower edge of the cover element 8 lies on an outer circumferential flange 75 of the cap 7. The cover element 8 together with the insulating pin 10 forms a means for preventing touching of the voltage-carrying parts.

The spring element 5 is arranged in a housing 9. The cover element 8 bears against an upwardly open edge of the housing 9.

Here, the spring element 5 provides a certain spring travel which exists both during the joining process and in the joined state, that is to say during operation. In this way, a vibration-resistant design of the high-current plug connection can be realized.

Figure 4:
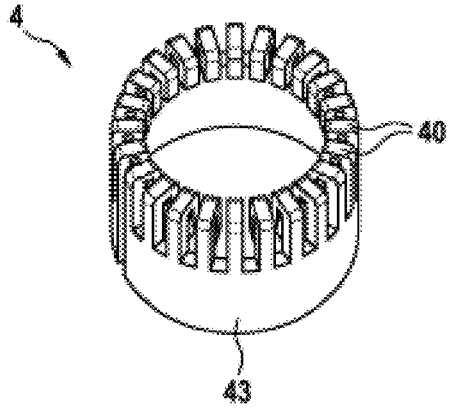
FIG. 4 shows a contact cage of the high-current plug connection of FIG. 1.
Figure 5:
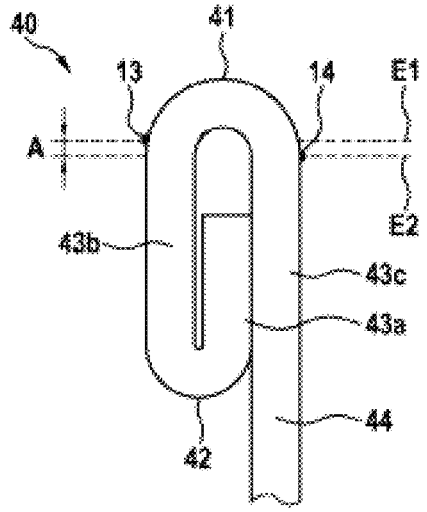
FIG. 5 shows a contact tongue in a detail of the contact cage of FIG. 4.
Figure 6:
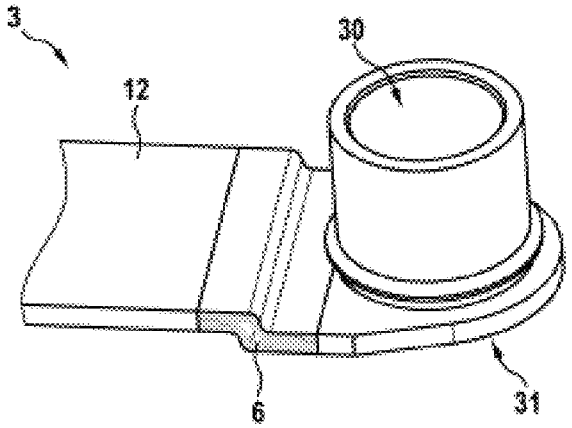
FIG. 6 shows a perspective view of a plug socket of FIG. 1 with a flexible connecting element.
Figure 7:
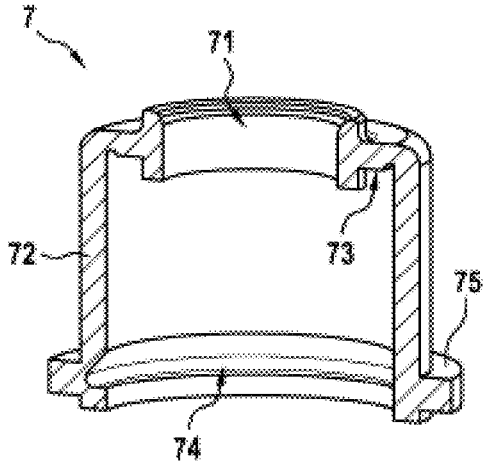
FIGS. 7 and 8 show views of a cap for the centering of the plug pin.
Figure 8:
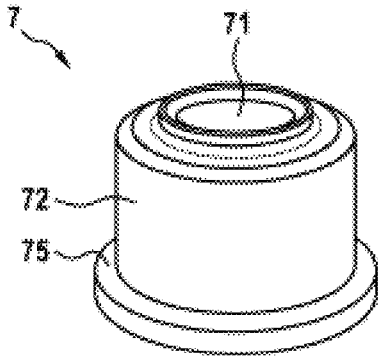

The contact cage 4 is shown in detail in FIGS. 4 and 5. The contact cage 4 comprises a multiplicity of contact tongues 40, which are arranged on a cylindrical base body 43. Here, the contact tongues 40 are arranged in an axial direction of the contact cage 4 on the cylindrical base body 43. The contact tongues are all of identical design.

FIG. 5 shows a detail of a contact tongue 40. The contact tongue 40 comprises a first 180° connection 41 and a second 180° connection 42. This gives rise, as shown in FIG. 5, to a spiral-like construction of each contact tongue. Here, each contact tongue has three straight regions 43*a*, 43*b* and 43*c* which are arranged parallel to one another. Depending on a length of a stem 44 of each contact tongue, the contact cage 4 has minimal resilient characteristics. As can be seen from FIG. 4, the stem 44 is designed to be as short as possible in an axial direction of the contact cage.

Figure 3:
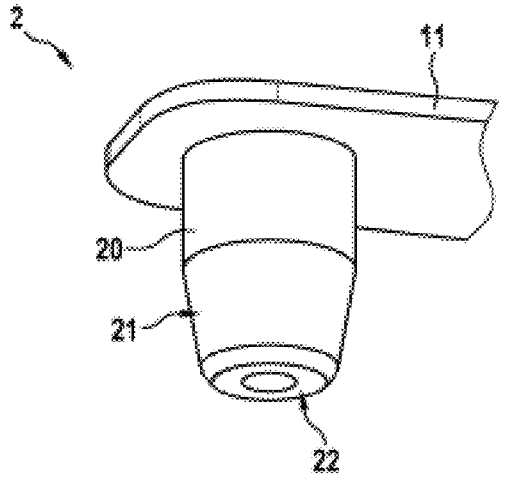
FIG. 3 shows a plug pin of the high-current plug connection of FIG. 1.

As can be seen from FIG. 3, the plug pin 2 has a main body 20 and a conical region 21. The main body 20 is electrically connected to the first line. A recess for receiving an insulating pin 10 is formed on an end side 22 of the plug pin 2.

Figure 2:
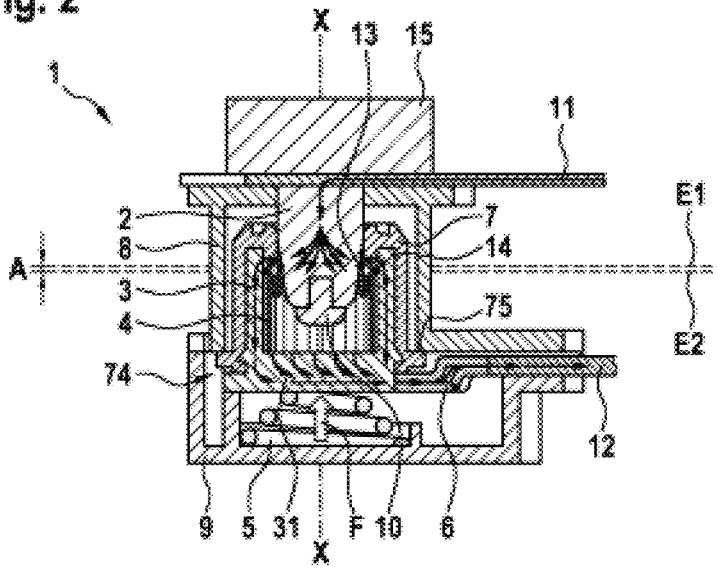
FIG. 2 shows a schematic sectional view of the high-current plug connection of FIG. 1, which illustrates a current flow through the plug connection.

As can be seen from FIGS. 1 and 2 and 5, electrical contact between the plug pin 2 and the plug socket 3 is produced via the contact cage 4. Here, a first contact region 13 with respect to the plug pin 2 and a second contact region 14 with respect to the plug socket 3 are formed on each contact tongue 40. Here, the first and second contact regions 13, 14 are linear areas of contact, that is to say a linear area region which has a certain width is provided as a contact region. As can be seen from FIG. 1, in this case, the first contact regions 13 lie in a first plane E1 and the second contact regions 14 lie in a second plane E2. The two planes E1, E2 are parallel to one another but spaced apart from one another by a small spacing A.

FIG. 2 shows, in detail, the current flow through the high-current plug connection 1, wherein the current flow is indicated by the arrows. Here, the current flows from the first line 11 via the plug pin 2 and the conical region 21 to the contact tongues 40 of the contact cage 4. At each contact tongue, the current flow runs from the first contact region 13 via the first 180° connection 41 to the second contact region 14, and from there into the plug socket 3. Furthermore, there is an additional current flow via the contact tongues 40 and the base body 43 to a bottom region 31 of the plug socket 3. Here, the base body 43 lies on the bottom region 31.

As can also be seen from FIG. 1, as a cooling element, a cooling body 15 is arranged, by means of an electrically insulating and thermally conductive foil 50, on a rear side of the plug pin 2. Effective cooling of the high-current plug connection 1 can be made possible in this way.

The high-current plug connection 1 has a very compact construction and, owing to the design with plug pin 2, plug socket 3 and contact cage 4, makes it possible to realize only low plugging forces, because the contact regions do not have to be expanded and a contact force acts only over a very short travel. The joining process of the high-current plug connection 1 is illustrated step-by-step in FIGS. 9*a* to 9*e*.

Figures 9A, 9B, 9C, 9D, 9E:
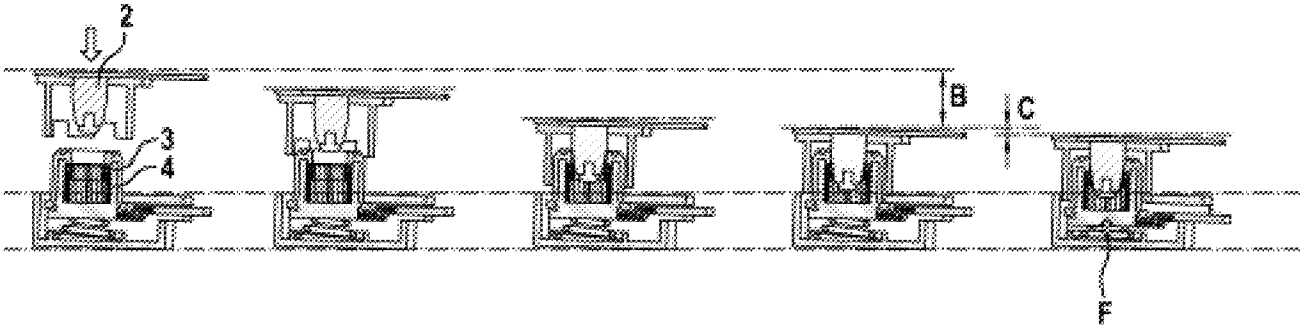
FIGS. 9*a*-9*e* show an illustration of the functional principle of the high-current plug connection according to the invention as per FIG. 1.

Here, FIG. 9*a* shows a state in which the plug connection is open. FIG. 9*b* shows a state in which preliminary centering takes place. Here, the preliminary centering takes place between the cap 7 and the cover element 8. FIG. 9*c* shows fine centering of the plug pin 2 in the passage opening 71 of the cap 7. Here, there is no longer contact between the cap 7 and the cover element 8. FIG. 9*d* shows the state in which the conical region 21 of the plug pin 2 comes into contact with the contact tongues 40 of the contact cage 4. Up to this point in time, joining between the plug pin 2 and the plug socket 3 has been possible in a force-free manner. This results in a large force-free joining range B, as indicated in FIGS. 9*a* to 9*d*. This is followed by a joining range C involving force, which is very small in relation to the force-free joining range B. The joining range C involving force amounts to approximately 1/10 to 1/5 of the force-free joining range B. FIG. 9*e* then shows the final state, that is to say the joined state, between plug pin 2 and plug socket 3. As is furthermore also indicated in FIGS. 9*a* to 9*e*, the joining process can be made possible even in the case of a non-horizontal orientation of plug pin and plug socket.

Thus, according to the invention, it is possible to realize a very low electrical and thermal transition resistance. A further major advantage of the invention lies in the fact that a highly conductive material such as copper or aluminum can be used as base material for the contact partners, that is to say the plug pin 2, the plug socket 3 and the contact cage 4. Furthermore, according to the invention, a relative movement at the contact regions 13, 14 between the plug pin 2, the plug socket 3 and the spring tongues 40 is prevented. The flexible connection element 6 accommodates a force acting in the axial direction X-X of the high-current plug connection 1 and thus keeps said force away from the contact regions. In order to further improve the contact resistances, it is also possible for the surfaces of the contact partners to be coated. Furthermore, the high-current plug connection according to the invention can also be joined in a concealed manner.

Figure 10:
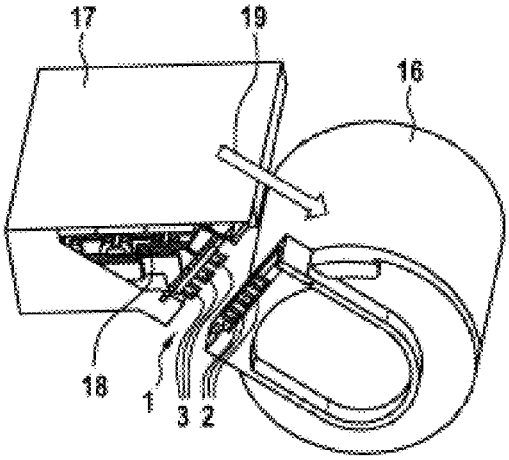
FIG. 10 shows an exemplary application of the high-current plug connection of FIG. 1.

One application of the high-current plug connection is shown in FIG. 10. FIG. 10 schematically shows an electric machine 16 and a control unit 17 with busbars 18. The high-current plug connection 1 shown in FIG. 1 is illustrated, in the non-connected state, between the electric machine and the busbar 18. The arrow 19 shows the installation direction or plugging direction for the high-current plug connection 1. On the electric machine 16, there may be provided a cooling circuit (not illustrated) which runs directly adjacent to the high-current plug connection 1 and which can thus also cool the latter. The high-current plug connection 1 according to the invention is usable in particular for applications in electric motors of vehicles, because the high-current plug connection 1 withstands high vibrational loads. By means of the wedge action of the conical region 21 of the plug pin 2, it is possible to realize high bracing forces between plug pin 2, contact cage 4 and plug socket 3, whereby even a relative movement in the μm range can be prevented.

Figure 11:
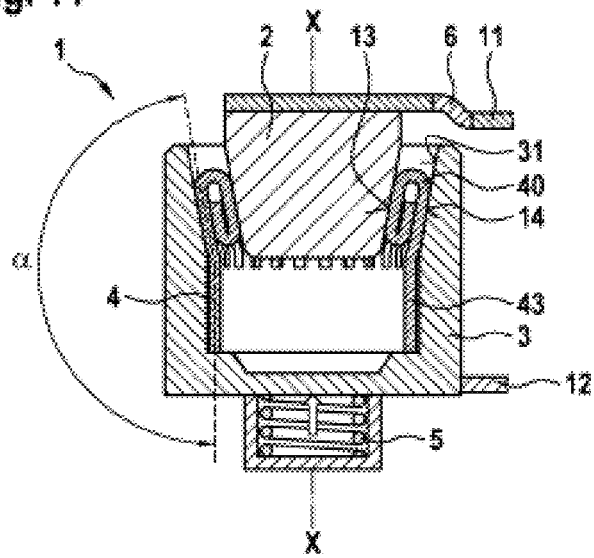
FIG. 11 shows a high-current plug connection according to a second exemplary embodiment of the invention.

FIG. 11 schematically shows a high-current plug connection 1 according to a second exemplary embodiment of the invention. Identical or functionally identical parts are denoted by the same reference designations. By contrast to the first exemplary embodiment, a first and second contact region 13, 14 with a large contact area are realized in the second exemplary embodiment. This is achieved in that, on the plug socket 3, there is provided a conical region 31 against which the contact tongues 40 of the contact cage 4 bear. The contact tongues 40 are in this case arranged at an angle α of approximately 160°, and likewise conically, with respect to the base body 43. The contact tongues 40 thus form a conical casing element. The conicity of the conical region 21 of the plug pin, of the contact tongues 40 and of the conical region 31 of the plug socket is preferably identical. In this way, it is possible to realize a force-free electrical connection with large first and second contact regions 13, 14, which are considerably larger than in the first exemplary embodiment.

As a further difference, the spring element 5 in the second exemplary embodiment is a cylindrical spring. The spring element 5 exerts a preload force F in the direction of the plug socket 3.

Figure 12:
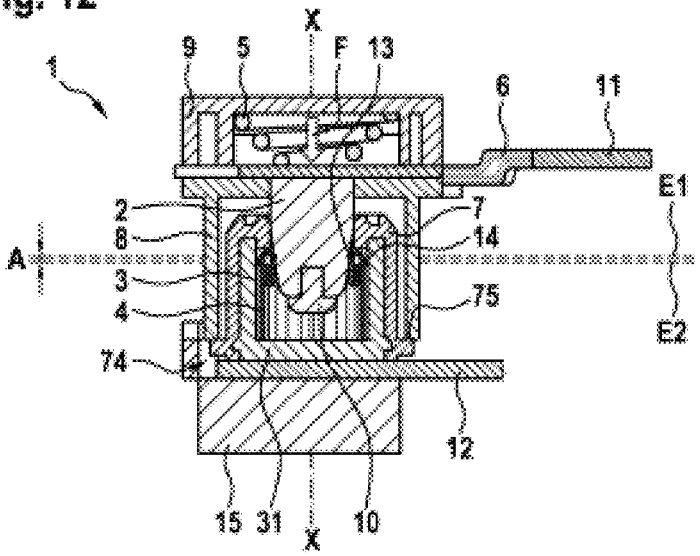
FIG. 12 shows a high-current plug connection according to a third exemplary embodiment of the invention.

FIG. 12 shows a high-current plug connection 1 according to a third exemplary embodiment of the invention. The third exemplary embodiment corresponds substantially to the first exemplary embodiment, wherein, by contrast to the latter, the arrangement of the spring element 5, of the cooling body 15 and of the flexible connection element 6 have been reversed. In other words, in the third exemplary embodiment, the spring element 5 is in direct contact with the plug pin 2 and exerts a preload force F in the axial direction X-X on the plug pin 2. The cooling body 15 is arranged on the plug socket 3, and the flexible connection element 6 is arranged between the plug pin 2 and the first line 11. Otherwise, this exemplary embodiment corresponds to the first exemplary embodiment, such that reference may be made to the description given in relation thereto.

The invention claimed is:

1. A high-current plug connection (1) for an electrical connection between a first line (11) and a second line (12), comprising:

a plug pin (2) which is connectable to the first line (11), a plug socket (3) which is connectable to the second line (12), a contact cage (4) which is arranged between the plug pin (2) and the plug socket (3) and which is configured to produce electrical contact between the plug pin (2) and the plug socket, and a spring element (5) which exerts a preload (F) in an axial direction (X-X) of the high-current plug connection, wherein the contact cage (4) includes a multiplicity of contact tongues (40) that move substantially in a radial direction of the high-current plug connection and into contact with the plug socket (3) upon insertion of the plug pin (2).

2. The high-current plug connection as claimed in claim 1, wherein the contact cage (4) has a cylindrical base body (43).

3. The high-current plug connection as claimed in claim 1, wherein each contact tongue (40) has a first 180° bend (41) and a second 180° bend (42).

4. The high-current plug connection as claimed in claim 1, wherein first contact regions (13) of the contact tongues (40) lie in a first plane (E1) and second contact regions (14) of the contact tongues lie in a second plane (E2), wherein the first plane (E1) is parallel to the second plane (E2).

5. The high-current plug connection as claimed in claim 2, wherein the contact tongues (40) form a cylindrical casing element or wherein the contact tongues (40) form a conical casing element.

6. The high-current plug connection as claimed in claim 1, furthermore comprising a cap (7) composed of an electrically insulating material, having a main body (72) and having a cover region with a passage opening (71) which is configured for a leadthrough of the plug pin (2).

7. The high-current plug connection as claimed in claim 6, wherein the passage opening (71) is a centering device for centering the plug pin (2).

8. The high-current plug connection as claimed in claim 1, wherein the plug pin (2) has, at an end side (22), an insulating element (10).

9. The high-current plug connection as claimed in claim 1, wherein the spring element (5) is a conical spring, wave spring, disk spring or a helical spring.

10. The high-current plug connection as claimed in claim 1, furthermore comprising a cover element (8) which is designed as a touch protection means and which is composed of an electrically insulating material and which is arranged on the plug pin (2).

11. The high-current plug connection as claimed in claim 1, wherein the spring element (5) bears against the plug socket and/or wherein the spring element (5) bears against the plug pin (2).

12. The high-current plug connection as claimed in claim 1, furthermore comprising a cooling element (15) which is arranged with an insulation foil (50) on the plug pin (2) and/or on the plug socket (3).

13. The high-current plug connection as claimed in claim 1, furthermore comprising a flexible connection element (6) by means of which the plug pin (2) is connectable to the first line (11) and/or by means of which the plug socket (3) is connectable to the second line (12).

14. A vehicle assembly comprising a high-current plug connection (1) as claimed in claim 1, configured to provide an electrical plug connection between an inverter and an electric machine or an electrical energy store.

15. A vehicle comprising an electric machine configured to drive the vehicle and comprising an inverter, wherein a high-current plug connection (1) as claimed in claim 1 provides an electrical plug connection between the electric machine and the inverter.

16. A high-current plug connection (1) for an electrical connection between a first line (11) and a second line (12), comprising:

a plug pin (2) which is connectable to the first line (11), a plug socket (3) which is connectable to the second line (12), a contact cage (4) which is arranged between the plug pin (2) and the plug socket (3) and which is configured to produce electrical contact between the plug pin (2) and the plug socket, and a spring element (5) which exerts a preload (F) in an axial direction (X-X) of the high-current plug connection, wherein the contact cage (4) has a cylindrical base body (43) and a multiplicity of contact tongues (40), wherein the contact tongues are in contact substantially in a radial direction of the high-current plug connection (1) with the plug pin (2) and the plug socket (3), and wherein the contact tongues (40) form a cylindrical casing element or wherein the contact tongues (40) form a conical casing element.

17. A high-current plug connection (1) for an electrical connection between a first line (11) and a second line (12), comprising:

a plug pin (2) which is connectable to the first line (11), a plug socket (3) which is connectable to the second line (12), a contact cage (4) which is arranged between the plug pin (2) and the plug socket (3) and which is configured to produce electrical contact between the plug pin (2) and the plug socket, and a spring element (5) which exerts a preload (F) in an axial direction (X-X) of the high-current plug connection, wherein the plug pin (2) has, at an end side (22), an insulating element (10).

18. A high-current plug connection (1) for an electrical connection between a first line (11) and a second line (12), comprising:

a plug pin (2) which is connectable to the first line (11), a plug socket (3) which is connectable to the second line (12), a contact cage (4) which is arranged between the plug pin (2) and the plug socket (3) and which is configured to produce electrical contact between the plug pin (2) and the plug socket, a spring element (5) which exerts a preload (F) in an axial direction (X-X) of the high-current plug connection, and a cooling element (15) which is arranged with an insulation foil (50) on the plug pin (2) and/or on the plug socket (3).

19. A vehicle comprising an electric machine configured to drive the vehicle and comprising an inverter, wherein a high-current plug connection (1) provides an electrical plug connection between the electric machine and the inverter, the high-current plug connection (1) for an electrical connection between a first line (11) and a second line (12), comprising:

a plug pin (2) which is connectable to the first line (11), a plug socket (3) which is connectable to the second line (12), a contact cage (4) which is arranged between the plug pin (2) and the plug socket (3) and which is configured to produce electrical contact between the plug pin (2) and the plug socket, and a spring element (5) which exerts a preload (F) in an axial direction (X-X) of the high-current plug connection.

* * * * *